US011193739B1

(12) United States Patent
Sarver

(10) Patent No.: US 11,193,739 B1
(45) **Date of Patent: *Dec. 7, 2021**

(54) METHOD AND APPARATUS FOR USE OF INTERACTIVE TARGETS

(71) Applicant: James Sarver, Blacksburg, VA (US)

(72) Inventor: James Sarver, Blacksburg, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/086,749

(22) Filed: Nov. 2, 2020

Related U.S. Application Data

(63) Continuation of application No. 16/889,403, filed on Jun. 1, 2020, now Pat. No. 10,823,536.

(51) Int. Cl.

| | |
|---|---|
| ***F41J 5/14*** | (2006.01) |
| ***F41J 5/04*** | (2006.01) |
| ***F41J 5/056*** | (2006.01) |
| ***F41G 3/26*** | (2006.01) |

(52) U.S. Cl.
CPC . *F41J 5/14* (2013.01); *F41J 5/04* (2013.01); *F41J 5/041* (2013.01); *F41J 5/056* (2013.01); *F41G 3/26* (2013.01)

(58) Field of Classification Search
CPC ..... F41J 5/14; F41J 5/04; F41J 5/041; F41J 5/02; F41J 5/048; F41J 5/056; F41J 5/06; F41J 5/052; F41J 5/205; F41J 11/00; F41J 1/10; F41J 3/0066; F41J 7/06; F41J 9/02; F41J 2/02; F41J 7/04; F41G 3/26
See application file for complete search history.

(56) References Cited

U.S. PATENT DOCUMENTS

| | | | | |
|---|---|---|---|---|
| 5,095,433 | A | 3/1992 | Botarelli | |
| 6,994,347 | B2 | 2/2006 | Tessel | |
| 7,207,566 | B2 | 4/2007 | Hodge | |
| 7,862,045 | B2 | 1/2011 | Hodge | |
| 8,356,818 | B2 | 1/2013 | Mraz | |
| 8,523,185 | B1 | 9/2013 | Gilbreath | |
| 9,435,617 | B2 | 9/2016 | Gamerman | |
| 9,759,530 | B2 * | 9/2017 | Miller | F41J 5/14 |
| 9,816,783 | B1 | 11/2017 | Means et al. | |
| 10,009,046 | B1 | 6/2018 | Armstrong | |

(Continued)

FOREIGN PATENT DOCUMENTS

| | | |
|---|---|---|
| WO | 2015 168 852 | 11/2015 |
| WO | 2016 065 259 | 4/2016 |

*Primary Examiner* — William H McCulloch, Jr.
(74) *Attorney, Agent, or Firm* — Emerson Thomson Bennett; Daniel A. Thomson

(57) ABSTRACT

An interactive target system including a first target assembly having a first target base operationally engaged with a first anchoring component, a first target surface rotatably engaged with, or fixed to, the first target base, a first spring adapted to bias the first target surface into the open position, a first electronics component having a first target GPS operationally engaged with the first target assembly, a first target strike status detector adapted to generate a first target strike count, and a first target electromagnetic signal transmitter and receiver, a first cooperating signal device having a first cooperating signal device GPS operationally engaged with the first cooperating signal device, a first cooperating signal device electromagnetic signal transmitter and receiver, a clock, and a first sound generator adapted to selectably generate a first notification sound.

19 Claims, 7 Drawing Sheets

(56) References Cited

U.S. PATENT DOCUMENTS

| | | | | |
|---|---|---|---|---|
| 10,060,712 | B2 | 8/2018 | Weiland | |
| 10,080,360 | B2 | 9/2018 | Hays | |
| 10,168,123 | B2 | 1/2019 | Lyren | |
| 10,179,283 | B2 | 1/2019 | Barney et al. | |
| 10,340,960 | B2 | 7/2019 | Armstrong | |
| 10,712,133 | B2 * | 7/2020 | Kerley | F41J 5/06 |
| 10,823,536 | B1 * | 11/2020 | Sarver | F41J 5/056 |
| 2005/0017456 | A1 | 1/2005 | Schechter | |
| 2005/0212216 | A1 | 9/2005 | Tessel | |
| 2006/0076736 | A1 | 4/2006 | Hodge | |
| 2006/0284380 | A1 * | 12/2006 | Casas | F41J 9/02 273/359 |
| 2007/0001400 | A1 | 1/2007 | Stewart | |
| 2007/0035528 | A1 | 2/2007 | Hodge | |
| 2008/0159079 | A1 | 7/2008 | Dir et al. | |
| 2008/0224410 | A1 | 9/2008 | Bengisson | |
| 2008/0277876 | A1 | 11/2008 | Riley | |
| 2012/0043722 | A1 | 2/2012 | Mironichev | |
| 2014/0367918 | A1 | 12/2014 | Miller | |
| 2015/0084281 | A1 | 3/2015 | Miller | |
| 2015/0285593 | A1 | 10/2015 | Dribben | |
| 2016/0195369 | A1 | 7/2016 | Perry | |
| 2016/0209173 | A1 | 7/2016 | Dribben | |
| 2016/0305749 | A9 | 10/2016 | Mason | |
| 2017/0343326 | A1 | 11/2017 | Weiland | |
| 2018/0149444 | A1 | 5/2018 | Pell | |
| 2018/0159565 | A1 | 6/2018 | Armstrong | |
| 2018/0339226 | A1 | 11/2018 | Barney et al. | |
| 2019/0126135 | A1 | 5/2019 | Tan | |
| 2019/0186876 | A1 | 6/2019 | Howe | |

* cited by examiner

METHOD AND APPARATUS FOR USE OF INTERACTIVE TARGETS

This application is a continuation of U.S. Ser. No. 16/889,403, filed Jun. 1, 2020, now U.S. Pat. No. 10,823,536, which claims priority to U.S. Ser. No. 62/855,083, filed May 31, 2019, the contents of which are herein incorporated by reference. The present teaching is directed to targets and target shooting. More specifically, the present teaching is directed to apparatuses and methods for an interactive target system and use thereof.

I. BACKGROUND

Shooting exercises, be they for training, fun, competitive, recreational, professional or otherwise, typically comprise a target or plurality of targets arranged on a course or target environment. One common form of shooting exercise is one in which the shooter must detect and acquire the target. Conventional targets are passive and do not respond to the position, proximity, facing, or skill of the shooter.

It remains desirable to provide an interactive target which is adapted to interact with the shooter by taking data regarding the shooter and providing output based thereon. It is also desirable to initially send data to the shooter.

II. SUMMARY

The present teaching comprises an interactive targeting system. The targets are three-dimensional and have multiple spots on the base for anchoring the target in place. The target's surface can be pivoted between an open and closed position, with the ability to bias the target into the open position with a spring. Once a target is hit, another may be released or pop up in a random or predetermined order. The targets have an electrical component for GPS, strike status detecting, and transmitting and receiving electromagnetic signals. The GPS generates the targets location. The target strike status detector generates a strike count and a signal indicative of the first target strike count. This information is transmitted to a cooperating signal device. This cooperating device has a clock, a sound generator, an electromagnetic signal transmitter and receiver, and a GPS. The GPS generates a signal indicating the location of the device. The sound generator generates a notification sound when the target is hit. The sound gives the shooter audio feedback in the form of a bell, tone, animal sound, voice notification, horn, beep, bottle shattering, or steel ringing.

Still other benefits and advantages of the present teaching will become apparent to those skilled in the art to which it pertains upon a reading and understanding of the following detailed specification.

III. BRIEF DESCRIPTION OF THE DRAWINGS

The present teachings are described hereinafter with reference to the accompanying drawings.

IV. DETAILED DESCRIPTION

Figure 1A:
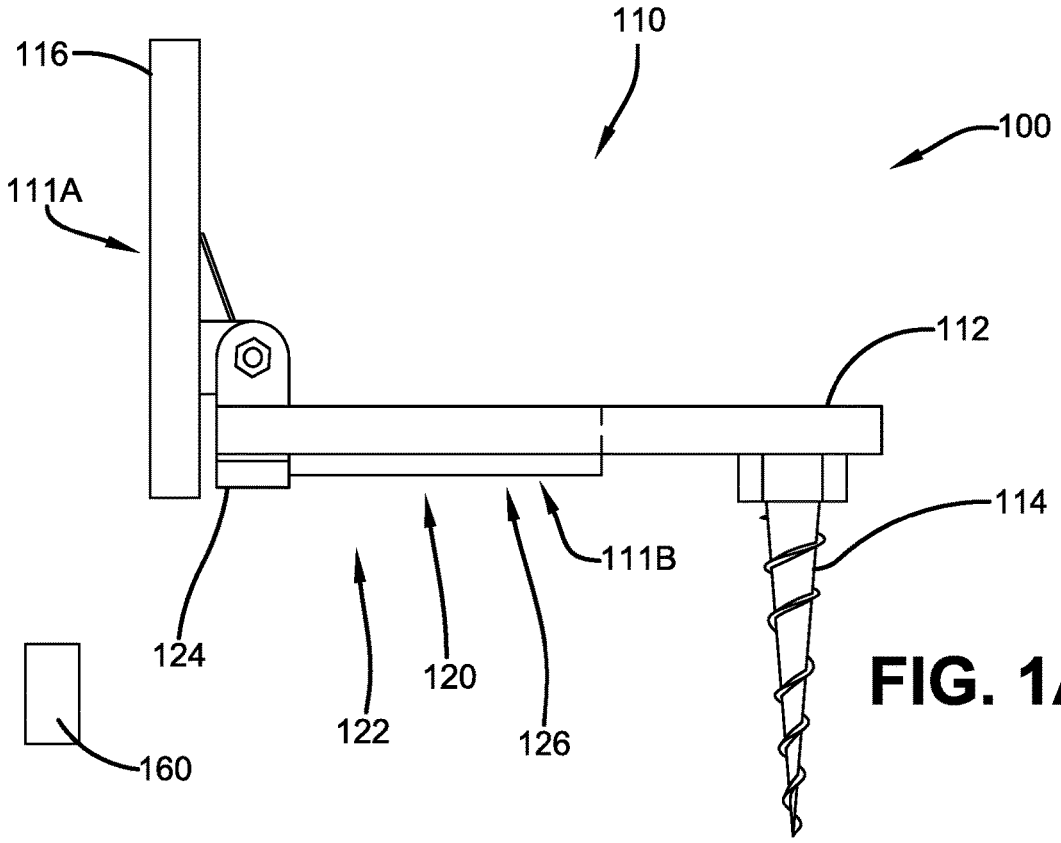
FIG. 1A is a side view of a first aspect of an interactive target.
Figure 1B:
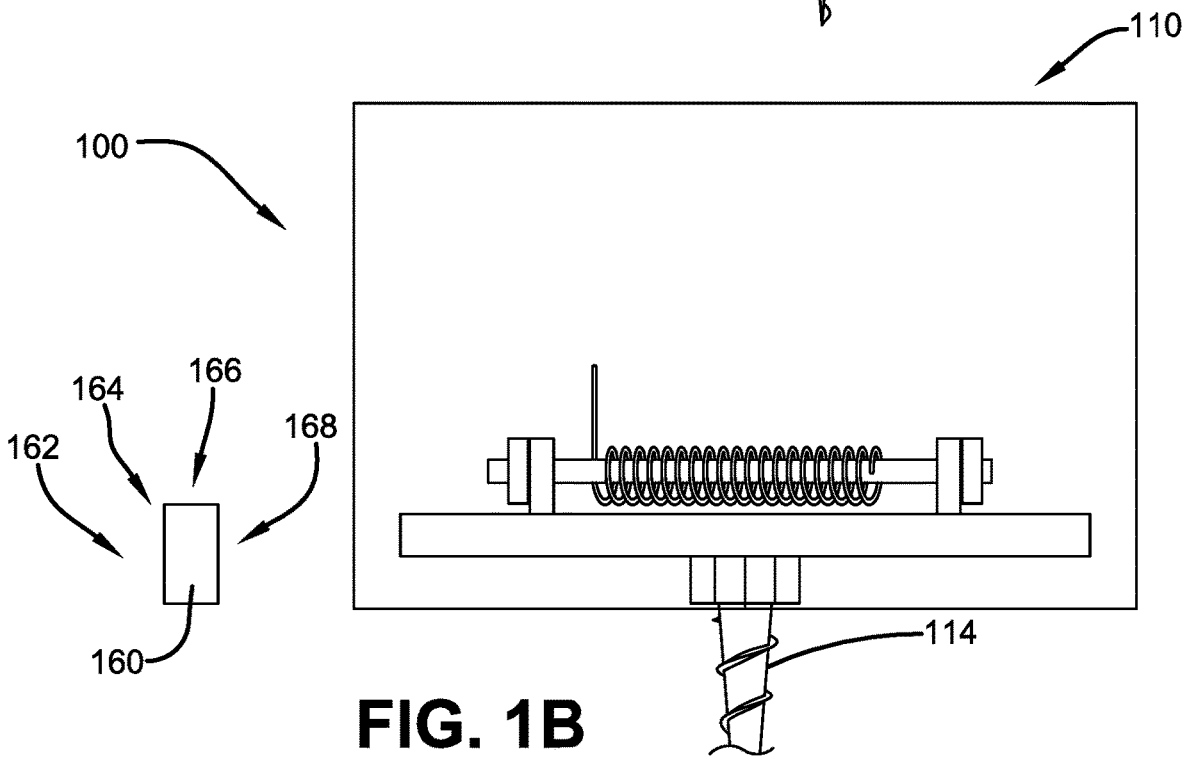
FIG. 1B is a rear view of the first aspect of an interactive target.
Figure 1C:
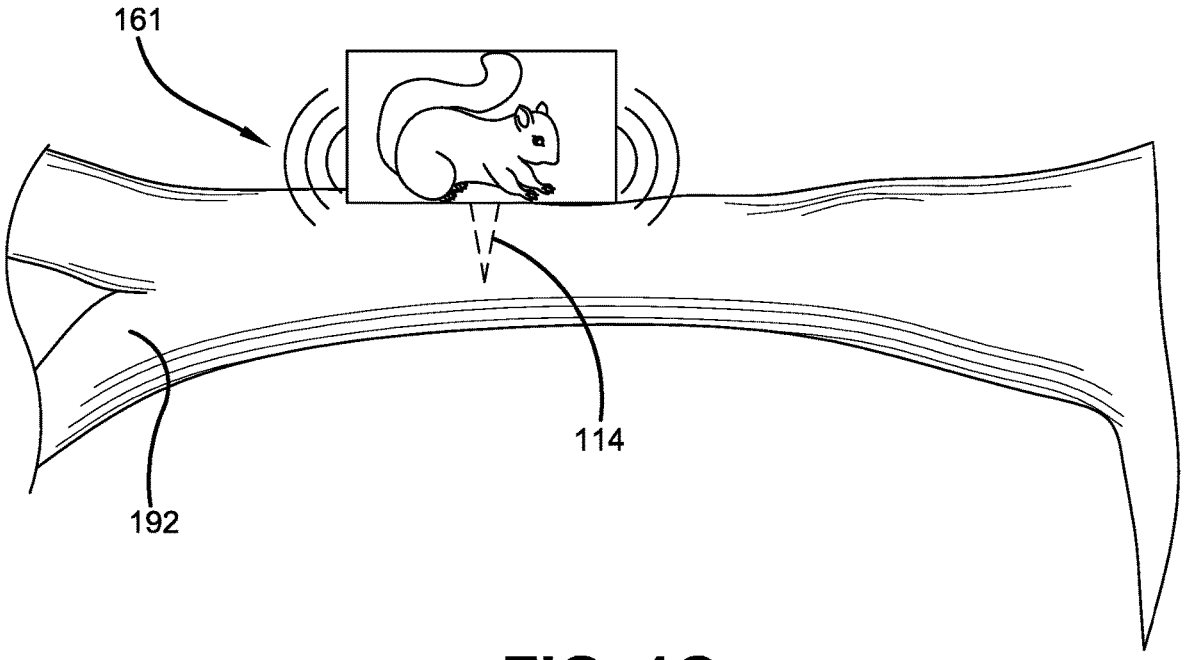
FIG. 1C is a front view of the first aspect of an interactive target engaged with an associated branch or log.
Figure 2A:
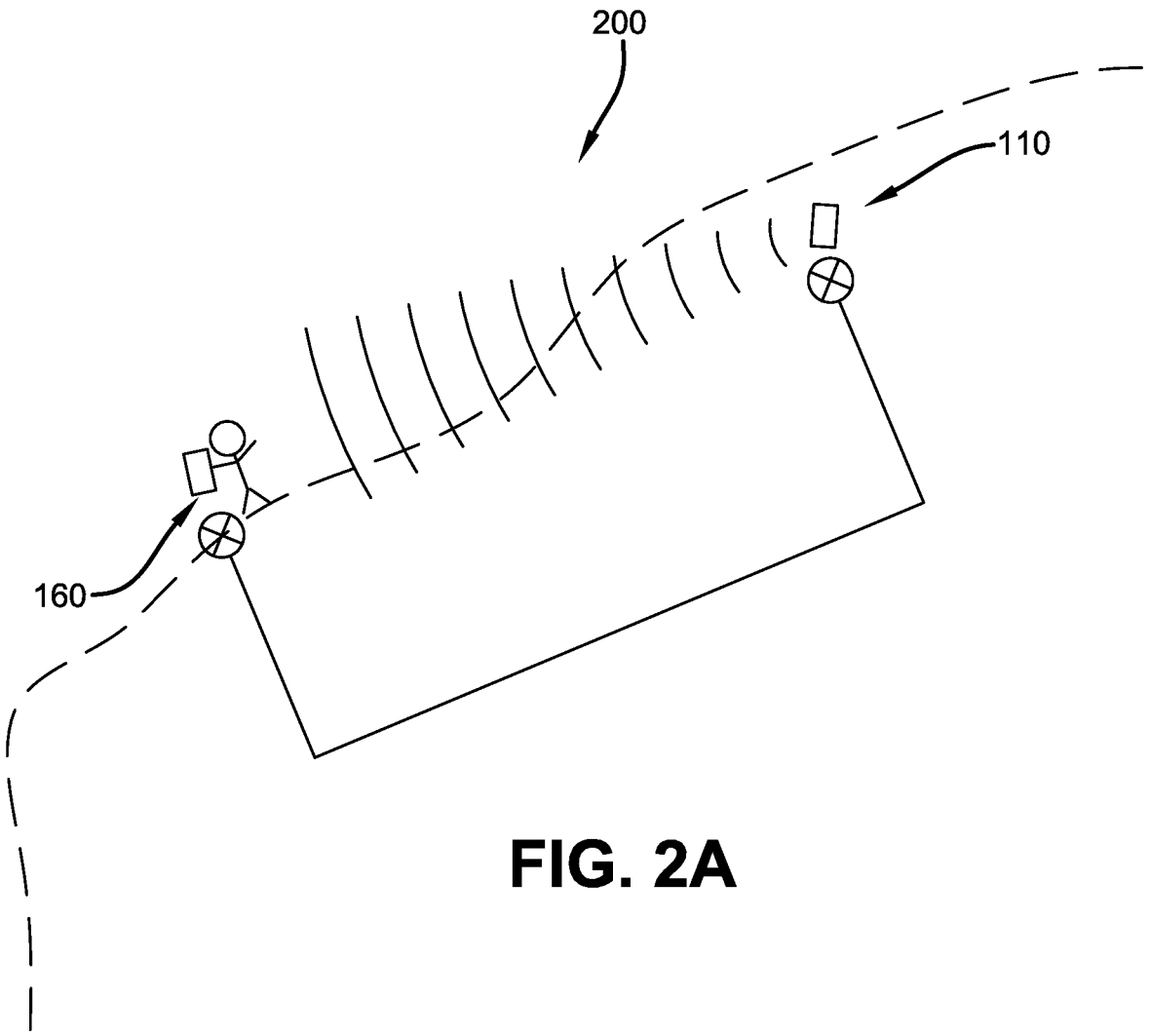
FIG. 2A is a first view of one aspect of an implementation of a first aspect of an interactive target interaction.
Figure 2B:
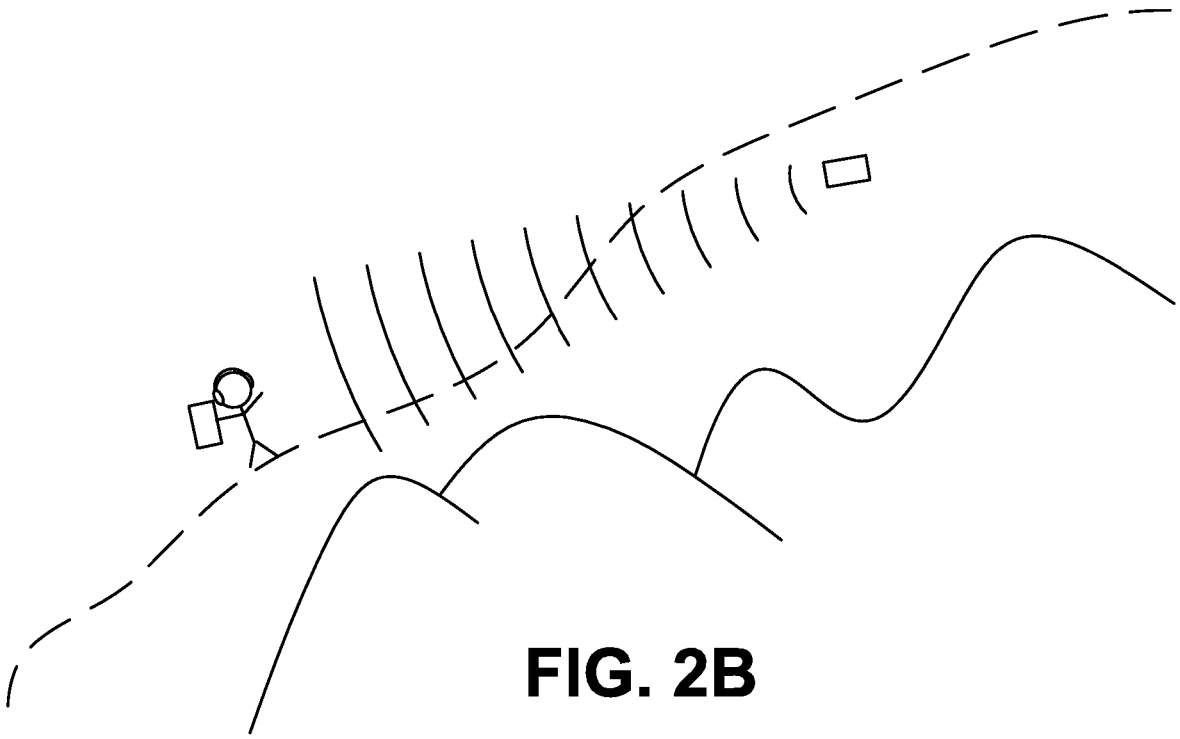
FIG. 2B is a second view of one aspect of an implementation of a first aspect of an interactive target interaction.
Figure 2C:
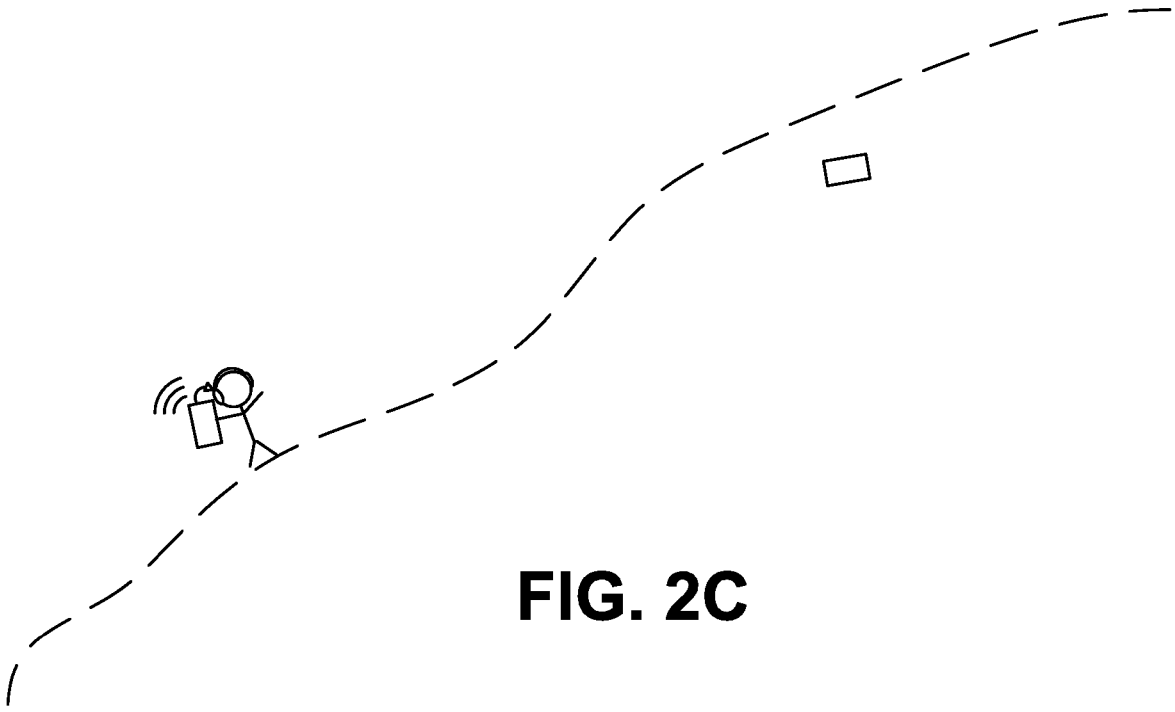
FIG. 2C is a third view of one aspect of an implementation of a first aspect of an interactive target interaction.
Figure 2D:
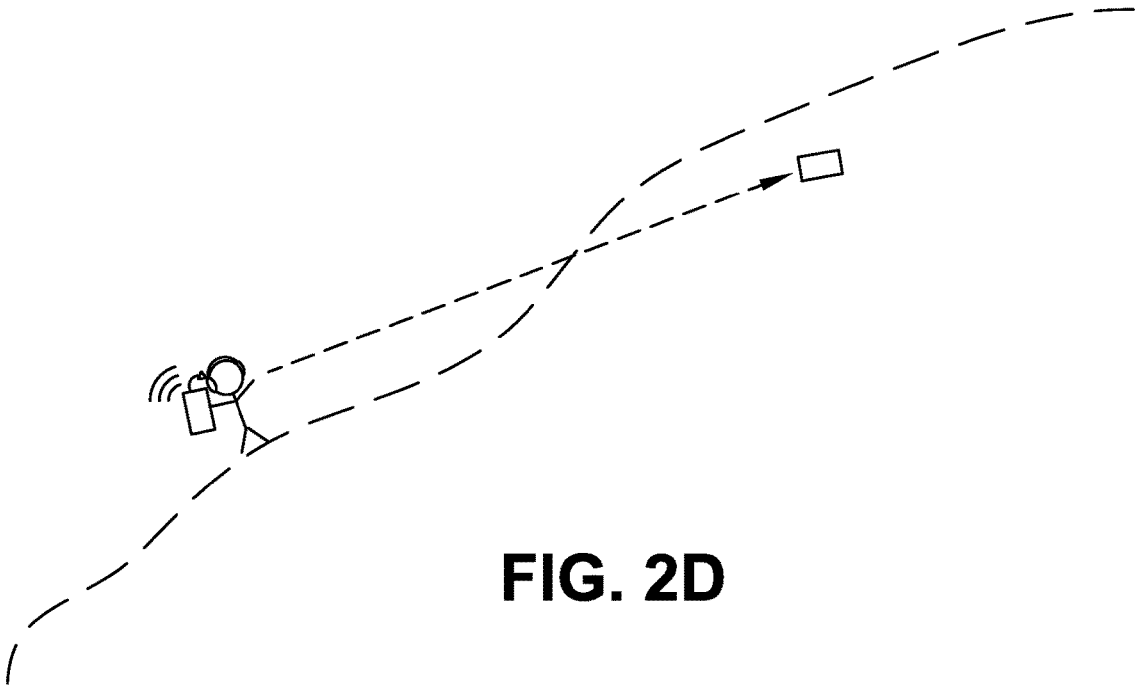
FIG. 2D is a fourth view of one aspect of an implementation of a first aspect of an interactive target interaction.
Figure 2E:
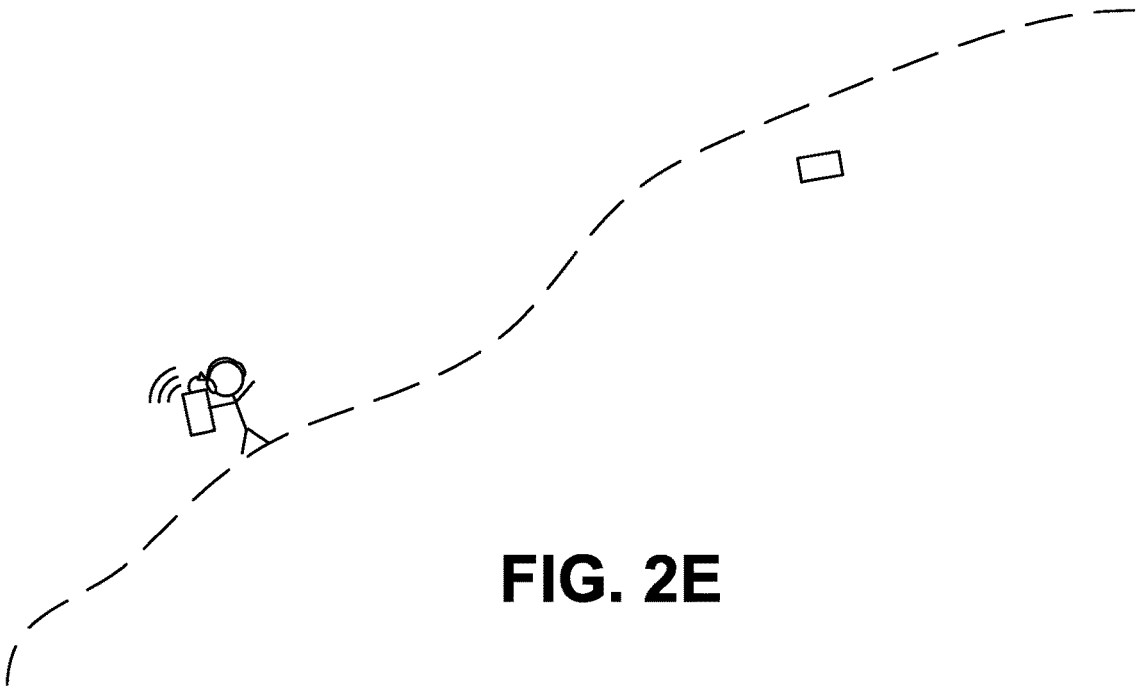
FIG. 2E is a fifth view of one aspect of an implementation of a first aspect of an interactive target interaction.
Figure 2F:
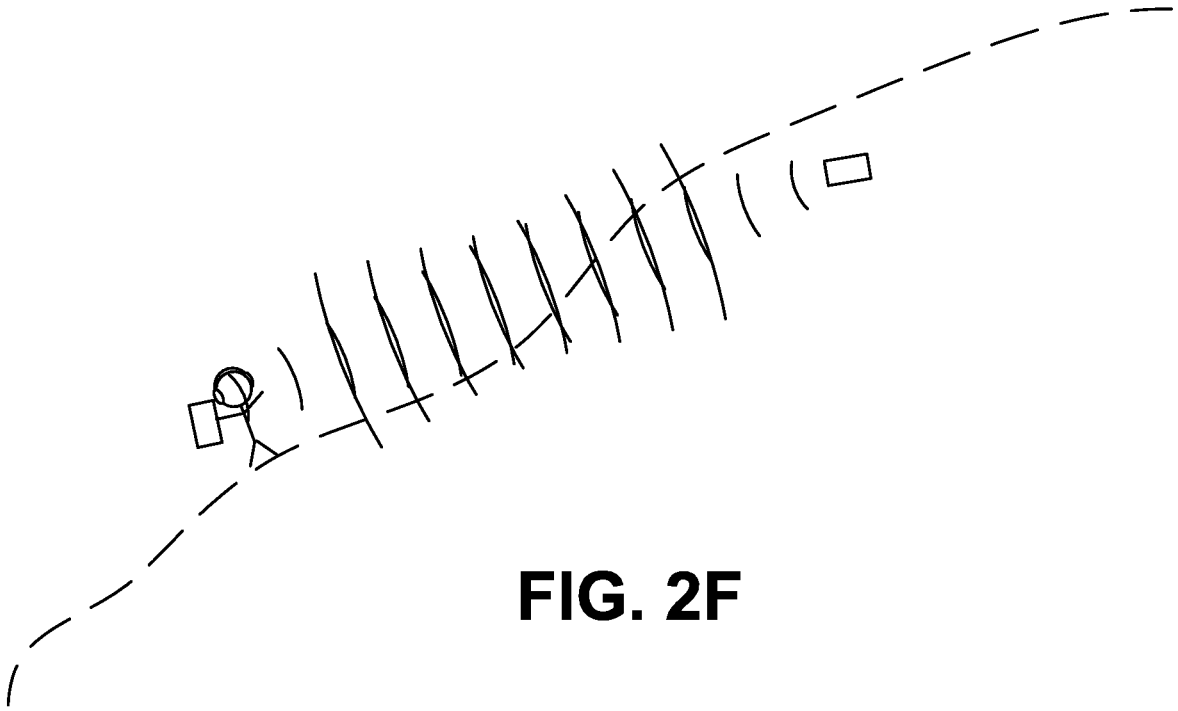
FIG. 2F is a sixth view of one aspect of an implementation of a first aspect of an interactive target interaction.

FIGS. 1A-1C, show one non-limiting aspect of an interactive target system 100 comprising a first target assembly 110 and a first cooperating signal device 160.

The first target assembly 110 may have a first target base 112 and a first target surface 116 rotatably engaged with, or permanently affixed to, the first target base 112 such that it may be pivoted between an open position 111A and a closed position 111B. In some aspects, the first target assembly 110 may have a first spring 113 operationally engaged therewith and adapted to bias the first target surface 116 into the open position 111A. In some non-limiting aspects, the first spring 113 may be a torsional spring but another kind of spring chosen with good engineering judgment may also be acceptable. In some aspects, the first target assembly 110 may have a first electronics component 120 operationally engaged therewith. Target surface 116 may also be weighted in order to achieve the same purpose. In some non-limiting aspects, the target surface 116 may be three-dimensional. The target surface 116 can have varying degrees of thickness to provide more or less resistance to projectile, which can used to determine exact strike location.

The first target base 112 may be operationally engaged with a first anchoring component 114. The first anchoring component 114 is adapted to anchor the first target assembly 110 to an associated environmental feature 192 such as, without limitation, a branch, tree limb, ground, or metal, plastic, or lumber post. The first anchoring component 114 may be a screw, spike, clamp, band, belt, or other component chosen with good engineering judgment. In some aspects, the target base 112 may be larger to allow multiple anchoring points.

The first electronics component 120 may have a first target GPS 122, a first target strike status detector 124, and a first target electromagnetic signal transmitter and receiver 126. The first target strike status detector 124 may be a switch or accelerometer. The first target GPS 122 may be operationally engaged with the first target assembly 110 and adapted to generate first target assembly location data. The first target strike status detector 124 may be adapted to generate a first target strike count and to generate a first target strike signal indicative of the first target strike count. Here a strike count is the number of times the target in question has been hit. A hit can be a hit from a bullet, arrow, slug, BB (metal, plastic, or rubber), pellet, foam dart, rubber ball, glass ball, gravel, marbles, laser, or other device that can shoot. Accordingly, the first target strike count is the number of times the first target has been hit. The first target electromagnetic signal transmitter and receiver 126 is adapted to send and receive data, such as, without limitation, a first target assembly location data, or first target strike count, or both.

The first target electromagnetic signal transmitter and receiver 126 may send data to, and receive data from, the first cooperating signal device 160 and optionally, one or more additional cooperating signal devices. In some non-limiting aspects, the interactive target system 100 may comprise a plurality of target assemblies, or a plurality of cooperating signal devices or both, and these target assemblies and cooperating signal devices may exchange data with one another to create an interactive network.

The first cooperating signal device 160 may have a first cooperating signal device GPS 162, a first cooperating signal device electromagnetic signal transmitter and receiver 164, a first sound generator 168, and, optionally, a clock 166. The first cooperating signal device GPS 162 may be operationally engaged with the first cooperating signal device 160 and adapted to generate first cooperating signal device location data. The clock 166 may generate time or duration data. The first cooperating signal device electromagnetic signal transmitter and receiver 164 is adapted to send and receive data, such as, without limitation, first cooperating signal device location data, or time or duration data, or both. Just as the first target electromagnetic signal transmitter and receiver 126 may send data to, and receive data from, the first cooperating signal device 160, first cooperating signal device electromagnetic signal transmitter and receiver 164 may send data to, and receive data from, the first target assembly 110. By extension, the first target electromagnetic signal transmitter and receiver 126 may send data to, and receive data from, any similarly equipped target, e.g., a second target assembly, third target assembly, hundredth target assembly, etc. The first cooperating signal device GPS data can be used to determine the distance between the shooter and the target surface 116, such that the shooter can be supplied with distance data related to a particular shot.

The first sound generator 168 may be adapted to selectably generate a first notification sound 161. The selectable generation may be triggered or halted (an increase/decrease in intensity) as determined by functions and variables measured by, received by, calculated by, or pre-set within the first cooperating signal device 160. The first notification sound 161 may be a bell, tone, animal sound, voice notification, horn, beep, or other sound. In another aspect, the first notification sound 161 can be real time communication through the target assembly 110 via a speaker/microphone from one person to another, or from a military commander through the target assembly 110, to be heard by a trainee.

The first target electromagnetic signal transmitter and receiver 126 may be operationally engaged with the first cooperating signal device electromagnetic signal transmitter and receiver 164 to exchange data sufficient for the first cooperating signal device 160 to calculate the relative position of the first cooperating signal device 160 with respect to the first target assembly 110. The first target electromagnetic signal transmitter and receiver 126 may send to the first cooperating signal device electromagnetic signal transmitter and receiver 164 the first target strike count data. The first cooperating signal device 160 may perform calculations using and comparisons of data available to it to generate selectable output and may further store data received, set, calculated, or measured.

For example, and without limitation, the first notification sound 161 may be generated by the first sound generator 168 as a function of the relative position of the first cooperating signal device 160 with respect to the first target assembly 110. More specifically, the first notification sound 161 may be generated if the relative distance between the first cooperating signal device 160 with respect to the first target assembly 110 drops below a first pre-set threshold.

In some non-limiting aspects, the first notification sound 161 may be generated by the first sound generator 168 as a function of the relative position of the first cooperating signal device 160 with respect to the first target assembly 110, and time or duration data from the clock 166. For example, and without limitation, the first notification sound 161 may be generated if the relative distance between the first cooperating signal device 160 with respect to the first target assembly 110 drops below the first pre-set distance threshold within a first pre-set time range.

In some non-limiting aspects, the first notification sound 161 may be generated by the first sound generator 168 as a function of the relative position of the first cooperating signal device 160 with respect to the first target assembly 110, and time or duration data from the clock 166, and first target strike data. For example, and without limitation, the first notification sound 161 may be generated if the first target strike count is at or below a first pre-set count threshold and may be terminated if the first target strike count is above the first pre-set count threshold. The first notification sound 161 may be used to reveal a hidden target to the shooter. In addition, each of the target assemblies 110 may communicate with one another, and the notification sound 161 emitting from one target assembly 110 may induce one or more other target assemblies to be revealed, to move, or to make a sound or sounds.

In some non-limiting aspects, the interactive target system 100 may use an animal motif for the appearance and sounds it uses. In some non-limiting aspects, the first target surface 116 is a silhouette of an animal, or animal head, or animal face, or human silhouette, head, or face. In some non-limiting aspects, the first target surface 116 may have an image of an animal, or animal head, or animal face applied thereon with paint, a decal, or a sticker.

In some non-limiting aspects, the first target surface 116 may further comprise a paper target, a target with the likeness of one or more animals, a steel target, a bottle, a self-healing plastic target, or a foam archery target.

In some non-limiting aspects the first notification sound 161 is an animal sound specific to an animal on the target, a steel clang if the first target surface 116 is steel (or if the user wants to replicate the sound of a steel strike), or a bottle shattering if the first target surface 116 is a bottle (or if the user wants to replicate the sound of a bottle shattering). It is to be understood that in one non-limiting aspect, the sound 161 can be any sound, even if the sound 161 does not match the image on the target surface 116. For example, a target surface 116 could be a picture of an animal, but still have the sound of a bottle shattering. The first notification sound 116 is designed to alert the user to the location of the target, thereby replicating an actual hunting situation, an active shooter situation, or actual military training.

In some non-limiting aspects, the first sound generator 168 uses surround sound technology or is compatible with Bluetooth headphones that are adapted to protect the shooters ears, as well as play music.

In some non-limiting aspects, the first target assembly 110 further comprises a skeet thrower to selectably launch a clay pigeon or other moving target.

In some non-limiting aspects the first target assembly 110 comprises a latch adapted to hold the first target surface in the closed position 111B and to selectably release the first target surface 116 allowing the first spring 113 to bias the first target surface 116 into the open position 111A. The target assembly 110 utilizes cabled movement, and in one aspect, the movement is initiated by the interaction with the shooter.

Referring now to FIGS. 2A-2F, the interactive target system 100 may be arranged in a course 200 to permit an associated user to move among, and move a carried first cooperating signal device 160, with respect to a first target assembly 110, and, optionally, one or more additional target assemblies, and optionally, one or more additional cooperating signal devices. Additional target assemblies can be activated in a random or predetermined pattern. Once a target is hit, another target may be released via an electronic switch or a mechanical trigger, so that the new target pops up or pops out to present the new target to the shooter. Targets can be held in place via a hook, clasp, etc. Real time data may be calculated by the first cooperating signal device 160 and used to determine what, if any, sounds to generate for the associated user or other output. The latter real time data may include data representing the distance between the first cooperating signal device 160, the first target assembly 110, and any other targets or cooperating signal devices, time, duration, shot counts for one or more targets, etc.

It should be understood that the first cooperating signal device 160 may comprise or consist of a cell phone, laptop computer, or other similarly enabled mobile device chosen with good engineering judgment. It should further be understood that an associated user may carry the first cooperating signal device 160 by hand, in a backpack, attached to a helmet or headwear, in a vehicle, or otherwise so that a mobile device for these purposes may range from small hand-held units to larger vehicle mounted apparatuses.

Where the first cooperating signal device 160 is a cell phone, the cell phone may interact with the first target assembly 110, and, optionally, one or more additional similar target assemblies, through a first mobile app. In certain non-limiting aspects the first mobile app may be initiated by proximity sensor/signal, or other prompt caused when the relative distance between the first cooperating signal device 160 with respect to the first target assembly 110 drops below a first pre-set distance threshold within a first pre-set time range, and may play the appropriate sound via surround sound technology programmed to correspond with the target mapped at course set up time. In certain non-limiting aspects, the first mobile app may be compatible with existing Bluetooth capable headphones that protect the shooters ears and can play music, etc. In certain non-limiting aspects, the first mobile app may facilitate real time communication such as, and without limitation, a third party "speaking" through target instead of a recorded sound or message. Such communication could be real-time or recorded messages. In one such non-limiting aspect, a LE/Military trainer can speak through the target's electronics and/or software app to trainees. In certain non-limiting aspects, the first mobile app may be linked to social media, for example, and without limitation, on video sharing such as YouTube®, for sharing purposes and advertising. The first mobile app may also gather and record barometric pressure, wind speed/direction, temperature, humidity, as well as the type of equipment used, such as weapon/projectile launcher, sights, accessories, ammunition, arrows, bolts, etc. The first mobile app will utilize this information to keep a log, to share information, and/or making recommendations to the shooter based upon the success of prior trials of the shooter, or other shooters.

In another aspect of the present teachings, the target sounds/interaction can be initiated by a third-party participant manually through the mobile app, or the shooter can initiate the sounds and/or movement through the handheld device. The target interaction would then be as described above with respect to the sounds, launching of a target, or movement of a target.

Figure 3A:
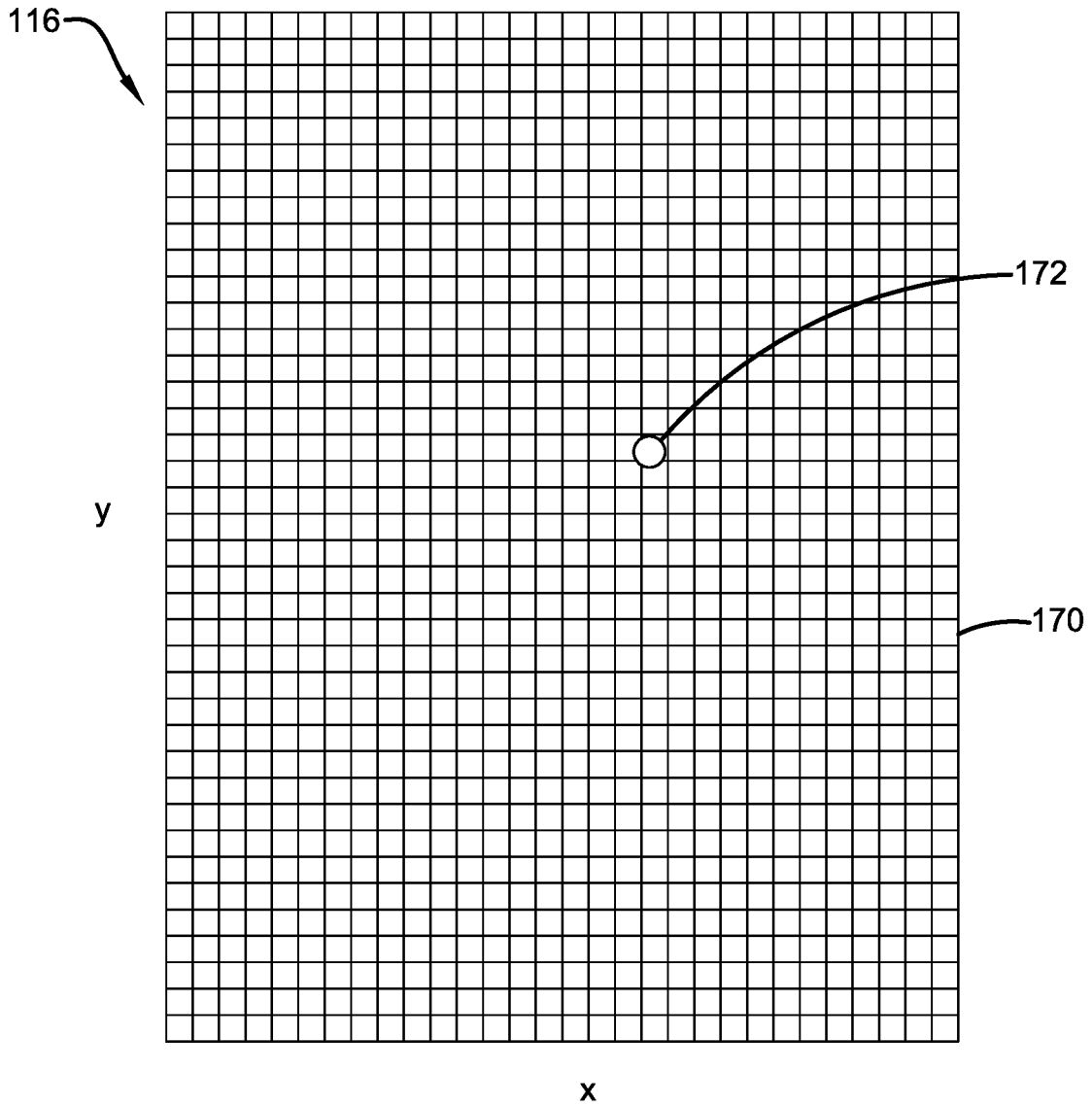
FIG. 3A is front view of a electrically conductive grid on a target.
Figure 3B:
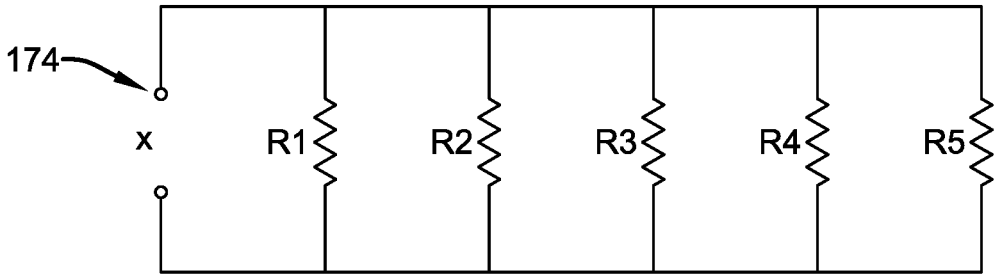
FIG. 3B is a schematic diagram of resistors.

With reference now to FIGS. 3A and 3B, the target surface 116' can be printed with an electrically conductive material 170, which will allow the user to determine the location of broken conductors using an xy coordinate system. Resistors 174 can be added to the conductive material 170 on an xy coordinate, which can then be connected to a power supply. This will allow the user to locate a bullet hole 172 on the target surface 116'.

Further examples consistent with the present teaching are set out in the following numbered clauses.

Clause 1.—An interactive target system comprising a first target assembly having a first target base operationally engaged with a first anchoring component, a first target surface rotatably engaged with, or fixed to, the first target base such that it may be pivoted between an open position and a closed position, a first spring adapted to bias the first target surface into the open position, a first electronics component having a first target GPS operationally engaged with the first target assembly, and adapted to generate first target assembly location data, a first target strike status detector adapted to generate a first target strike count, and generate a first target strike signal indicative of the first target strike count, and a first target electromagnetic signal transmitter and receiver; a first cooperating signal device having a first cooperating signal device GPS operationally engaged with the first cooperating signal device and adapted to generate first cooperating signal device location data, a first cooperating signal device electromagnetic signal transmitter and receiver, a clock, and a first sound generator adapted to selectably generate a first notification sound; and wherein the first target electromagnetic signal transmitter and receiver is operationally engaged with the first cooperating signal device electromagnetic signal transmitter and receiver to exchange data sufficient for the first cooperating signal device to calculate the relative position of the first cooperating signal device with respect to the first target assembly, and the first target strike count.

Clause 2—The interactive target system of clause 1, wherein the first notification sound is generated by the first sound generator as a function of the relative position of the first cooperating signal device with respect to the first target assembly.

Clause 3—The interactive target system of clauses 1 or 2, wherein the first notification sound is generated if the relative distance between the first cooperating signal device with respect to the first target assembly drops below a first pre-set threshold.

Clause 4—The interactive target system of clause 1-3, wherein the first notification sound is generated if the relative distance between the first cooperating signal device with respect to the first target assembly drops below a first pre-set distance threshold within a first pre-set time range.

Clause 5—The interactive target system of clauses 1-4, wherein the first notification sound is terminated if the first target strike count is above a first pre-set count threshold.

Clause 6—The interactive target system of clauses 1-5, wherein the first anchoring component is a screw, spike, or clamp.

Clause 7—The interactive target system of clauses 1-6, wherein the first target surface is a silhouette of an animal, or animal head, or animal face.

Clause 8—The interactive target system of clauses 1-6, wherein the first target surface has an image of an animal, or animal head, or animal face, or human head, face, or silhouette, applied thereon with paint, a decal, or a sticker.

Clause 9—The interactive target system of clauses 1-8, a) wherein the first target surface further comprises a paper target, a target with the likeness of one or more animals or humans, a steel target, a bottle, a self-healing plastic target, or a foam archery target; or b) wherein the first notification sound is an animal sound, bottle shatter sound, or steel clang sound specific to the object or animal on the target (or the sound does not have to match the image on the target); or c) wherein the first sound generator uses surround sound technology; or d) wherein the first sound generator is compatible with Bluetooth headphones that are adapted to protect the shooters ears, transmit sound from a speaker at the target base, wherein the sound can be a real time human voice transmitted through a speaker or a mobile app, and play music; or e) wherein the first target assembly further comprises a skeet thrower to selectably launch a clay pigeon or other moving target; or f) wherein the first target assembly comprises a latch adapted to hold the first target surface in the closed position; and selectably release the first target surface allowing the first spring to bias the first target surface into the open position.

Clause 11—A method of using an interactive target system comprising providing an interactive target system having a first target assembly having a first target base operationally engaged with a first anchoring component, a first target surface rotatably engaged with, or fixed to, the first target base such that it may be pivoted between an open position and a closed position, a first spring adapted to bias the first target surface into the open position, a first target GPS operationally engaged with the first target assembly, and adapted to generate first target assembly location data, a first target strike status detector adapted to generate a first target strike count, and generate a first target strike signal indicative of the first target strike count, and a first target electromagnetic signal transmitter and receiver; a first cooperating signal device having a first cooperating signal device GPS operationally engaged with the first cooperating signal device and adapted to generate first cooperating signal device location data, a first cooperating signal device electromagnetic signal transmitter and receiver, a clock, and a first sound generator adapted to selectably generate a first notification sound; and wherein the first target electromagnetic signal transmitter and receiver is operationally engaged with the first cooperating signal device electromagnetic signal transmitter and receiver to exchange data sufficient for the first cooperating signal device to calculate the relative position of the first cooperating signal device with respect to the first target assembly, and the first target strike count; and moving the first cooperating signal device with respect to the a first target assembly; and shooting the first target assembly.

Clause 12—The method of using an interactive target system of claim 11, wherein the method of using an interactive target system comprises use of the interactive target system in course or shooting range, wherein the sound may be made in order for the target to be located by the shooter.

Non-limiting aspects have been described, hereinabove. It will be apparent to those skilled in the art that the above methods and apparatuses may incorporate changes and modifications without departing from the general scope of the present subject matter. It is intended to include all such modifications and alterations in so far as they come within the scope of the appended claims or the equivalents thereof.

Having thus described the present teachings, it is now claimed:

1. An interactive target system comprising:

a first target assembly having a first target surface operationally engaged with a first anchoring component, a first electronics component having a first target strike status detector adapted to generate a first target strike count, and generate a first target strike signal indicative of the first target strike count, and a first target electromagnetic signal transmitter and receiver, and wherein the first target assembly location is generated through first mobile app;

a first cooperating signal device having a first cooperating signal device GPS operationally engaged with the first cooperating signal device and adapted to generate first cooperating signal device location data, and a first cooperating signal device electromagnetic signal transmitter and receiver, wherein the first target electromagnetic signal transmitter and receiver is operationally engaged with the first cooperating signal device electromagnetic signal transmitter and receiver to exchange data sufficient for the first cooperating signal device to calculate the relative position of the first cooperating signal device with respect to the first target assembly, and the first target strike count.

2. The interactive target system of claim 1, further comprising a first spring adapted to bias the first target surface into the open position.

3. The interactive target system of claim 2, wherein the first target surface is operatively connected to the first anchoring component via a first target base, such that the first target surface may be pivoted between an open position and a closed position.

4. The interactive target system of claim 1, wherein the first anchoring component is a screw, strap, spike, or clamp.

5. The interactive target system of claim 3, wherein the first target surface is a silhouette of an animal, or animal head, or animal face.

6. The interactive target system of claim 5, wherein the first target surface has an image of an animal, or animal head, or animal face, or human head, face, or silhouette, applied thereon with paint, a decal, or a sticker.

7. The interactive target system of claim 6, a) wherein the first target surface further comprises a paper target, a target with the likeness of one or more animals or humans, a steel target, a bottle, a self-healing plastic target, or a foam archery target; or b) wherein the first target assembly further comprises a skeet thrower to selectably launch a clay pigeon or other moving target; or c) wherein the first target assembly comprises a latch adapted to hold the first target surface in the closed position; and selectably release the first target surface allowing the first spring to bias the first target surface into the open position; or d) a robotic target.

8. The interactive target system of claim 1, further comprising:

a first sound generator adapted to selectably generate a first notification sound.

9. The interactive target system of claim 8, wherein the first sound generator is a speaker attached to the first target assembly.

10. A method of using an interactive target system comprising:

providing an interactive target system having a first target assembly having a first target surface operationally engaged with a first anchoring component, a first target strike status detector adapted to generate a first target strike count, and generate a first target strike signal indicative of the first target strike count, and a first target electromagnetic signal transmitter and receiver, and wherein the first target assembly location is generated through first mobile app;

a first cooperating signal device having a first cooperating signal device GPS operationally engaged with the first cooperating signal device and adapted to generate first cooperating signal device location data, a first cooperating signal device electromagnetic signal transmitter and receiver, and wherein the first target electromagnetic signal transmitter and receiver is operationally engaged with the first cooperating signal device electromagnetic signal transmitter and receiver to exchange data sufficient for the first cooperating signal device to calculate the relative position of the first cooperating signal device with respect to the first target assembly, and the first target strike count; and moving the first cooperating signal device with respect to the first target assembly; and shooting the first target assembly.

11. The method of claim 10, further comprising a first spring adapted to bias the first target surface into the open position.

12. The method of claim 11, wherein the first target surface is operatively connected to the first anchoring component via a first target base, such that the first target surface may be pivoted between an open position and a closed position.

13. The method of using an interactive target system of claim 10, wherein the method of using an interactive target system comprises use of the interactive target system in course or shooting range.

14. The method of claim 13, wherein the first anchoring component is a screw, strap, spike, or clamp.

15. The method of claim 14, wherein the first target surface is a silhouette of an animal, or animal head, or animal face.

16. The method of claim 15, wherein the first target surface has a image of an animal, or animal head, or animal face, or human head, face, or silhouette, applied thereon with paint, a decal, or a sticker.

17. The method of claim 16, a) wherein the first target surface further comprises a paper target, a target with the likeness of one or more animals or humans, a steel target, a bottle, a self-healing plastic target, or a foam archery target; or b) wherein the first target assembly further comprises a skeet thrower to selectably launch a clay pigeon or other moving target; or c) wherein the first target assembly comprises a latch adapted to hold the first target surface in the closed position; and d) selectably release the first target surface allowing the first spring to bias the first target surface into the open position.

18. The method of claim 10, wherein the interactive target system further comprises:

a first sound generator adapted to selectably generate a first notification sound.

19. The method of claim 18, wherein the first sound generator is a speaker attached to the first target assembly.

* * * * *